United States Patent [19]

Babiol

[11] 4,422,563

[45] Dec. 27, 1983

[54] NESTABLE POURING SPOUT ASSEMBLIES

[75] Inventor: Pierre Babiol, Villefranche sur Saone, France

[73] Assignee: Societe Nouvelle de Bouchons Plastiques, Anse, France

[21] Appl. No.: 282,624

[22] Filed: Jul. 13, 1981

[30] Foreign Application Priority Data

Jul. 23, 1980 [FR] France ..... 80 16401

[51] Int. Cl.[3] ..... B65D 25/44; B65D 47/36

[52] U.S. Cl. ..... 222/153; 222/529; 222/530; 220/85 SP

[58] Field of Search ..... 222/153, 529, 530, 538; 220/85 SP

[56] References Cited

U.S. PATENT DOCUMENTS 4,236,629 12/1980 Dwinell ..... 222/530 X

FOREIGN PATENT DOCUMENTS 1533032 7/1967 France .

2142571 2/1973 France .

*Primary Examiner*—Joseph J. Rolla

*Assistant Examiner*—Frederick R. Handren

*Attorney, Agent, or Firm*—Dowell & Dowell

[57] ABSTRACT

The present invention relates to a container construction provided with a nestable pouring spout assembly integral with a collar fitted with respect to the opening of the container and comprising a tubular sleeve adapted to be retracted and nested within the container or pulled to an upstanding extended positon for pouring. A threaded cap closure is adapted to be screwed onto the tubular sleeve. The periphery of the head of the cap is provided with two half-rings connected to the periphery of the head by means of frangible bridges, the half-rings forming disengagement levers. A vertical rib fixed to the periphery of each half-ring is provided for preventing access to the head when the tubular sleeve is nested in storing position.

3 Claims, 6 Drawing Figures

NESTABLE POURING SPOUT ASSEMBLIES

The present invention relates to improvements in nestable pouring spout assemblies of the type comprising a flexible tubular sleeve adapted to have two positions. At one of these positions the flexible tubular sleeve is entirely nested into the container on which the pouring spout is assembled, while at the other position the pouring spout is in upstanding extended position with respect to the container.

Such pouring spouts are desirable because of their reduced height in nested position, which facilitates their positioning onto an opening in a container.

The main drawback of this kind of pouring spout consists of its lack of to prevent violation thereof means.

This invention aims at providing a nestable pouring spout, said spout including means for preventing extension of its flexible sleeve by introducing a flat member between the head of its cap closure and the collar of the spout which surrounds the opening of the container. This invention further aims at providing a pouring spout wherein the spout includes means for preventing violation of the cap closure by unscrewing with respect to the flexible threaded sleeve in nested position of the spout.

The accompanying drawing which is given by way of example will enable the invention, its characteristics and advantages to be better understood.

FIG. 2 is a corresponding top view, which indicates a cross-sectional plane in I—I through which FIG. 1 is taken.

FIG. 6 is a corresponding top view which shows the cross-sectional plane III—III through which FIG. 5 is taken.

Figure 1:
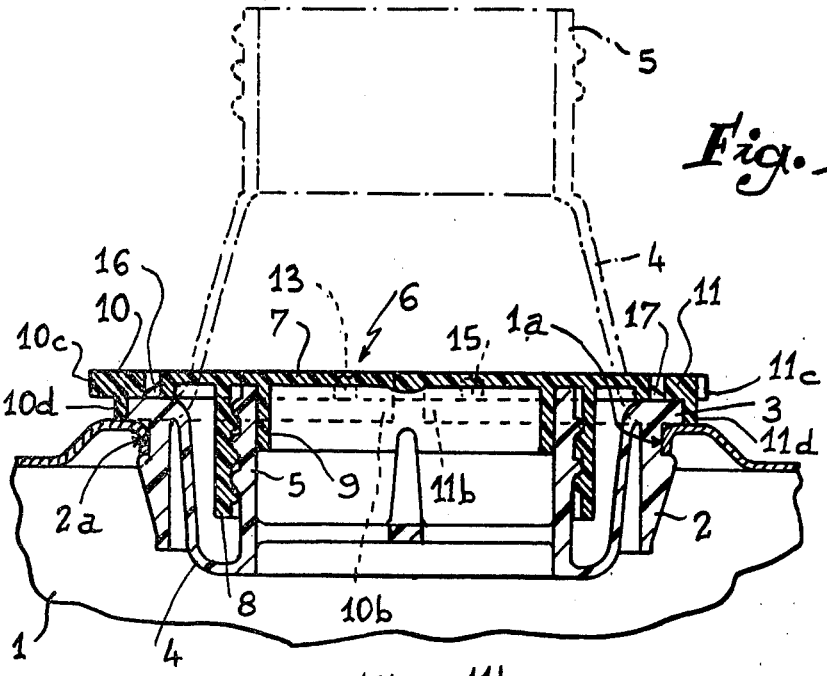
FIG. 1 is a sectional view of a pouring spout according to a first embodiment of the invention, illustrated when installed on a container's opening.
Figure 2:
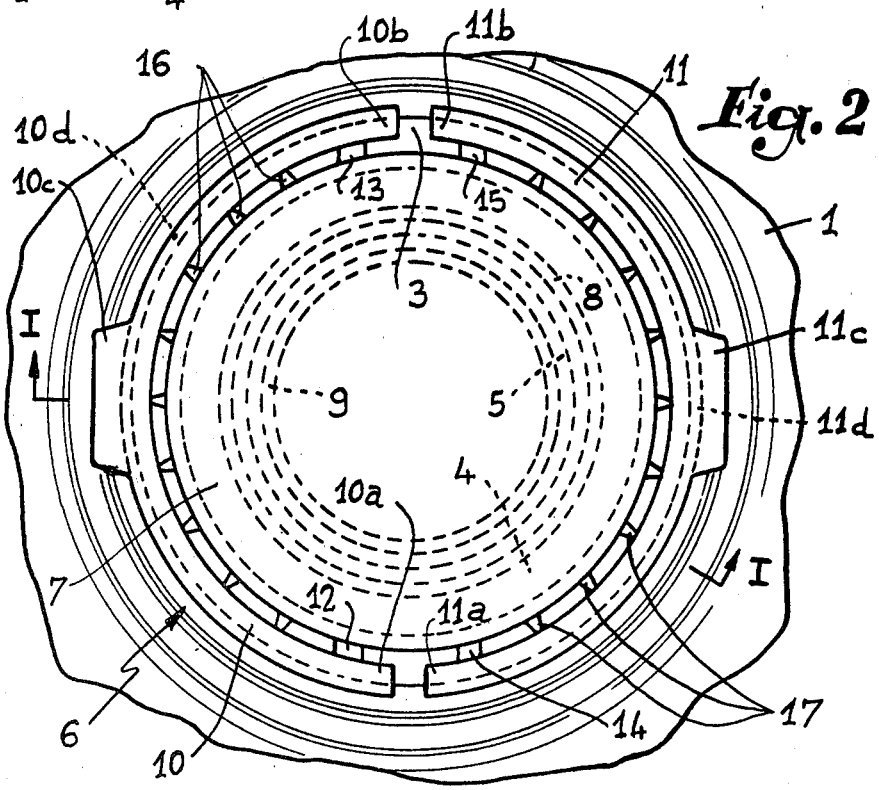
Figure 3:
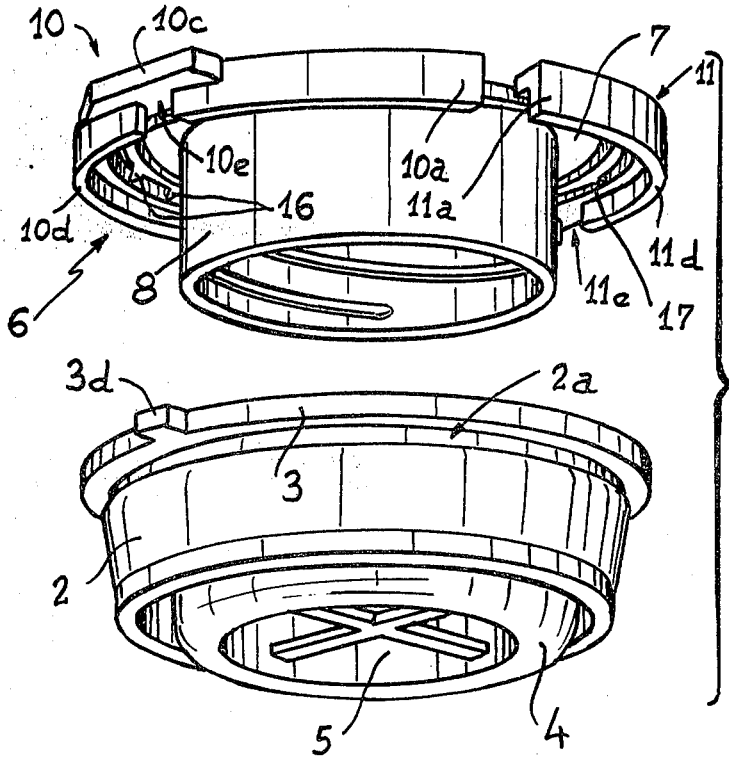
FIG. 3 shows the means preventing the cap closure from unscrewing.
Figure 4:
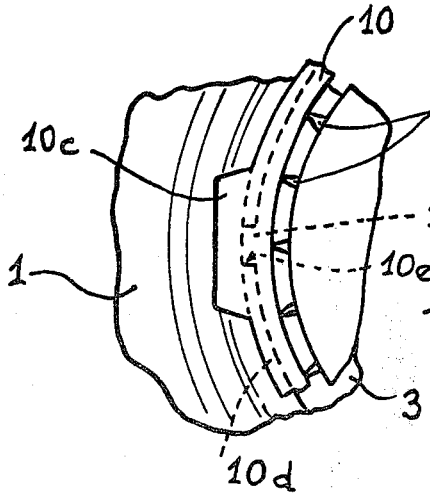
FIG. 4 is a corresponding partial top view.

FIG. 1 illustrates a partial view of the upper portion of a container 1 comprising a circular opening 1*a* with a downwardly tubular edge. The container 1 as illustrated is made of tinplate and used for motor oil stocking. As already known in the art, a collar 2 made of plastic material is put into the opening 1*a* in such a way that a groove 2*a* of said collar 2 snaps onto said edge of the opening 1*a* of the container 1. It can be noted that the upper portion of the collar is shaped to provide a flange 3 applied against the top of the container 1. This flange 3 extends inwardly through a flexible tubular sleeve 4 which is made thin and which is joined to an extension of sleeve 5. As is well known in the art, the pouring spout consisting of the flexible tubular sleeve 4 and of the extension of sleeve 5 can be retracted so that it is nested into the container 1 or extended out of it, as illustrated with dotted lines on FIG. 1.

A closure cap 6 is provided on the extension of sleeve 5, said cap comprising a flat head 7, a threaded skirt 8 cooperating with the threaded portion of said extension of sleeve 5, and a tubular boss 9 penetrating with a minimum clearance into the central hole through the extension of sleeve 5. The periphery of the head 7 is surrounded by two half-rings 10, 11 whose annular lengths are less than its semi-circumference. Each ring is made integral with the head 7 by means of two fixing lugs 12, 13 and by lugs 14, 15, respectively oriented in pairs facing one another. Each half-ring extends beyond said fixing lugs to form a leg 10*a*, 10*b* and a leg 11*a*, 11*b*, respectively to facilitate the extraction of the sleeve 4 by pivoting of the half-rings. Each half-ring further includes a central manual gripping ear 10*c*, 11*c* improving its gripping. Finally the periphery of the head 7 of the cap 6 is connected to each ring by frangible bridges referenced respectively as 16 and 17.

It can be noted, in FIG. 1, that the lower portion of each ring 10 and 11 is provided with a vertical rib 10*d*, 11*d* downwardly orientated, the free edge of which rests against the portion of the container surrounding its opening 1*a*. Thus the introduction, for instance, of a blade between the head 7 and the upper portion of the flange 3 is made impossible so that the sole way to extend the sleeve 4 outwards is to manually pull the gripping ears 10*c*, 11*c* of the half-rings 10, 11 upwardly this movement causing the rupture of the frangible bridges 16, 17 so that it can be immediately seen whether the cap has already been taken off or not.

In order to avoid a non authorized unscrewing of the cap 6 when the pouring spout is nested in the container 1, another embodiment could provide on the periphery of the flange 3 of the collar 2 protrusions comprising two radial studs 3*d*, 3*e*, the latter being not illustrated. Each rib 10*d*, 11*d* is then interrupted in order to constitute a notch 10*e* respectively 11*e* wider than the studs 3*d*, 3*e*. Therefore after screwing the cap 6 onto the extension of sleeve 5, when the flexible tubular sleeve is out of the container so that the studs can deflect downwardly until falling into a notch, the penetration of said sleeve into said container causes clamping of the opposed mutually intefering notches and radial studs 3*d*, 3*e* so that in this position the cap 6 is made angularly fixed with respect to the collar 2.

Figure 5:
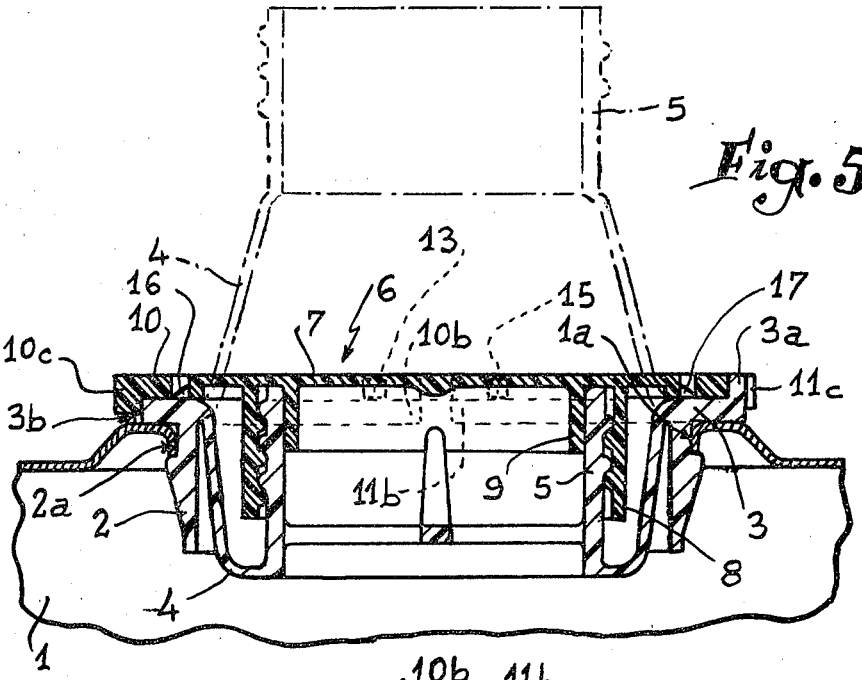
FIG. 5 is a view similar to the one of FIG. 1 but illustrating a second embodiment of the invention.
Figure 6:
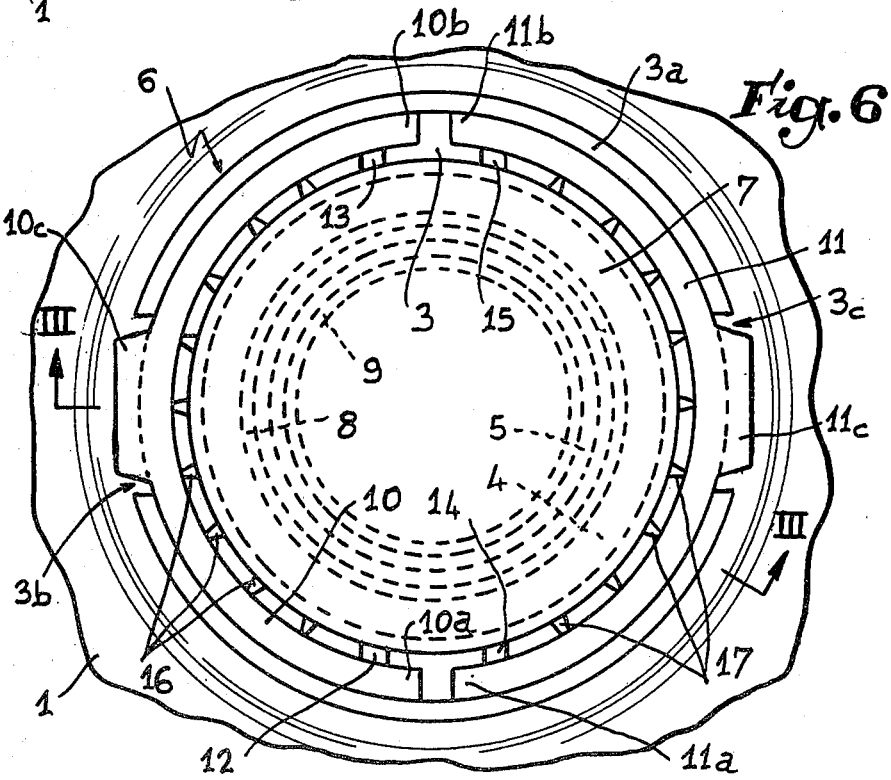

The nestable pouring spout illustrated in FIG. 5 and 6 includes most of the same elements as the ones represented in FIG. 1 to 4.

As illustrated additional means of inviolableness comprise an upwardly extending edge 3*a* broken at the two gripping ears 10*c*, 11*c* of each ring 10, 11 in order to constitute two notches 3*b*, 3*c*. In this embodiment too it is impossible to introduce a blade or similar device under the head 7 of the cap 6 because such an action between the flange 3 and one of the half-rings 10, 11 would automatically cause the rupture of the guarantee frangible bridges 16, 17. Furthermore it is not possible to unscrew the cap from the threaded portion of sleeve 5 since the gripping ears 10*c*, 11*c* comprise protrusions locked by two notches 3*b*, 3*c* of the edge e*a*.

A nestable pouring spout has thus been made comprising on the one hand means of easy extraction using the two half-rings 10, 11 and on the other hand means of inviolableness giving to this pouring spout particular utility in use of it.

It should in addition be understood that the above description has been given only as an example and that it does not in any way limit the scope of the invention, which will not be departed from by replacing the details of construction described by any other equivalent.

What is claimed is:

1. A retractable pouring spout assembly for attaching to a container having an opening extending through one of its surfaces, the assembly comprising:

(a) a collar shaped to be inserted into said opening and be fixed to the container and having an upper periphery, the collar having a flexible tubular sleeve joined thereto and moveable between an upstanding extended position exposing an upper portion of the sleeve for pouring and a retracted position wherein said upper portion is nested within the collar and the container, said upper portion of the sleeve being threaded, and the upper periphery of the collar comprising annular flange means surrounding the collar and overlying the surface of the container;

(b) a closure cap having a threaded portion adapted to screw onto said upper threaded portion of the sleeve and having a head portion overlying and closing the sleeve, and the head portion having an outer periphery comprising annular half-rings overlying the annular flange means of the collar and having downwardly extending annular rib means surrounding said annular flange means and abutting the surface of the container, the half-rings being integrally connected to the head portion of the cap by multiple frangible bridges, whereby the half-rings can be disengaged from the upper periphery of the collar when the bridges are ruptured; and (c) means for preventing unscrewing of the closure cap when the sleeve is nested in the container comprising, mutually interfering protrusions and notches opposedly carried by said annular means of the collar and of the closure cap.

2. An assembly as claimed in claim 1, wherein said preventing means comprises multiple notches in said annular rib means of the cap and located opposite said annular flange means, and further comprises on said flange means multiple radial studs located to engage in said notches and comprising said protrusions.

3. A retractable pouring spout assembly for attaching to a container having an opening extending through one of its surfaces, the assembly comprising:

(a) a collar shaped to be inserted into said opening and be fixed to the container and having an upper periphery, the collar having a flexible tubular sleeve joined thereto and moveable between an upstanding extended position exposing an upper portion of the sleeve for pouring and a retracted position wherein said upper portion is nested within the collar and the container, said upper portion of the sleeve being threaded, and the upper periphery of the collar comprising annular flange means surrounding the collar and overlying the surface of the container;

(b) a closure cap having a threaded portion adapted to screw onto said upper threaded portion of the sleeve and having a head portion overlying and closing the sleeve, the head portion having an outer periphery comprising annular half-rings overlying the annular flange means of the collar, and the half-rings being integrally connected to the head portion of the cap by multiple frangible bridges, whereby the half-rings can be disengaged from the upper periphery of the collar when the bridges are ruptured; and (c) means for preventing unscrewing of the closure cap when the sleeve is nested in the container comprising, multiple gripping ears carried by said half-rings and comprising outwardly extending protrusions, and further comprising upwardly extending ribs fixed to the outer periphery of the collar and having notches therein located to receive said gripping ears.

* * * * *